United States Patent [19]

Niemela

[11] 4,206,743

[45] Jun. 10, 1980

[54] HEATING APPARATUS

[76] Inventor: W. Wally Niemela, Box 165E, Chassell, Mich. 49916

[21] Appl. No.: 798,989

[22] Filed: May 20, 1977

[51] Int. Cl.[2] ..... F24H 3/06

[52] U.S. Cl. ..... 126/110 B; 126/61; 126/77; 126/112; 126/113; 110/297

[58] Field of Search ..... 126/60-67, 126/77, 163 R, 112, 110 B, 113; 110/75 R, 75 B

[56] References Cited

U.S. PATENT DOCUMENTS

| | | | |
|---|---|---|---|
| 149,803 | 4/1874 | Sprague | 126/113 X |
| 1,341,580 | 5/1920 | Pelton | 126/77 |
| 1,974,143 | 9/1934 | Spencer | 110/75 R |
| 2,289,206 | 7/1942 | Nessell | 126/110 B X |
| 3,010,449 | 11/1961 | Owen | 126/110 B |
| 3,168,088 | 2/1965 | Martin et al. | 236/95 X |
| 3,171,399 | 3/1965 | Kirgan | 126/110 B |
| 3,469,518 | 9/1969 | Howard | 98/42 |
| 4,030,479 | 6/1977 | Webb | 126/67 X |
| 4,047,515 | 9/1977 | Daniel | 126/67 X |
| 4,111,181 | 9/1978 | Canney | 126/77 |

*Primary Examiner*—William E. Wayner
*Assistant Examiner*—William E. Tapolcai, Jr.
*Attorney, Agent, or Firm*—Price, Heneveld, Huizenga & Cooper

[57] ABSTRACT

A maximum efficiency stove or furnace for heating homes or other buildings. The stove includes a primary combustion area for burning a primary fuel, such as wood, and secondary combustion areas for burning the gases of combustion after they leave the primary combustion area. The combustion chambers and areas are at least partially surrounded by air heating enclosures through which ambient room air is forced, preferably by a fan, for heating. Air for sustaining combustion is preheated in a preheating chamber and fed through separate intakes to both the primary and secondary combustion areas. A single draft control is provided to control air flow through the preheating chamber and to simultaneously control the flow of preheated air to and through both said primary and secondary combustion air intakes.

24 Claims, 10 Drawing Figures

HEATING APPARATUS

BACKGROUND OF THE INVENTION

This invention relates to stoves and furnaces, and, more particularly, to a maximum efficiency stove or furnace especially adapted for burning wood and other solid fuels including a primary combustion area for burning a primary fuel and secondary combustion areas for further combusting the gases of combustion which leave the primary combustion area.

Stoves and furnaces for burning wood and other solid fuels have long been known. Many, if not most, of the prior known stoves and furnaces are designed principally to burn only the primary wood or other fuel in order to heat surrounding air and provide warmth in a home or other building. With fire wood, it is known that only 40 percent of the heat value or BTU content of a quantity of wood fuel is obtained by the primary burning of that fuel. Approximately 60 percent of the heat value or BTU's remain in the gases of combustion which escape through an exhaust or chimney. Many, if not most, of the prior known structures provide no method for extracting that remaining 60 percent of the heat value and transferring that heat to the surrounding air. Such stoves do not provide any secondary combustion of the primary combustion gases and, therefore, operate at a severely reduced efficiency based on the quantum of heat actually present in the fuel being burned.

A related problem in many prior known stoves or furnaces is the lack of proper draft control of air utilized to sustain combustion. Even if apparatus is included for at least partially burning the gases of primary combustion, a critical problem results if air utilized to sustain either the primary or secondary combustion is not adequately controlled. Thus, too great a quantity of primary combustion air and too little secondary combustion air creates an overly hot primary burn without sufficient air or oxygen to sustain the secondary combustion. Conversely, too little primary combustion air and too great an amount of secondary combustion air creates a low temperature primary burn and little or no secondary combustion.

Another problem is that of blending and mixing air or oxygen necessary to sustain either primary or secondary combustion. Such air must be introduced into the primary or secondary combustion areas at a temperature which enhances and does not detract from combustion in either area. Further, prior stoves have not introduced such fresh air into the combustion area at the proper locations for efficient burning.

Prior known stoves or furnaces have also provided generally inefficient methods of heating ambient or surrounding room air and transferring heat from the process of combustion to that air. Even if sufficient combustion of a fuel is obtained, heat transferred to the air in the vicinity of the combustion area is often inadequate.

Other related problems with the operation of stoves or furnaces include the inability to properly humidify or add moisture to the heated air to prevent discomfort from the dryness which results from such heating.

SUMMARY OF THE INVENTION

Accordingly, the present invention provides a maximum efficiency heating stove or furnace providing primary combustion of wood or other fuel as well as secondary combustion of the gases resulting from the primary combustion in order to extract a maximum amount of heat from the fuel being burned. Air for sustaining combustion in the primary and secondary combustion areas is preheated before insertion in either the primary or secondary combustion areas so as to maintain efficient combustion in both areas. Although commonly inducted into the preheat area, the preheated air is separately inserted in the primary and secondary combustion areas. Control of a draft opening in the preheat area simultaneously controls the flow of preheated, combustion air to both the primary and secondary areas. Ambient room air is heated quickly and efficiently in an air heating enclosure around the combustion areas.

In one aspect, the invention comprises a heating stove or furnace including a combustion enclosure having a primary combustion chamber for burning fuel and a secondary combustion area in fluid communication with the primary combustion chamber for receiving and further combusting the gases of combustion from the primary combustion chamber. An air heating enclosure at least partially surrounds the combustion enclosure for passing ambient air for heating. Combustion air intake means for controlled admission of fresh, ambient air to the primary combustion chamber and the secondary combustion area are provided, the intake means including means for preheating the fresh, ambient air prior to admission to the combustion chamber and area. An exhaust outlet is provided for exhausting the products of combustion after passage through and combustion in the secondary combustion area. Ambient air intake means are included for admitting ambient air to the air heating enclosure along with a heated air outlet for exhausting heated air from the air heating enclosure. Means for inserting fuel in the primary combustion chamber are also provided.

In other aspects, air heating passageways may be provided between the secondary combustion areas to further enhance the efficiency of heating of the ambient room air by the stove or furnace. Also, separate primary and secondary combustion air intakes may be provided for admitting fresh air through the primary and secondary combustion areas together with preheat means for preheating the ambient air and directing the preheated air to the primary and secondary combustion air intakes as controlled by a common draft-control means on the preheating means. Further, the primary combustion air is directed into the primary combustion chamber from below and along the sides of a grate which supports the wood or other fuel being burned therein.

Other aspects of the invention include a humidifier for adding moisture to the heated air provided by the stove and heat-deflecting means for directing heated air to various parts of the room in which the stove is situated.

The above features provide numerous advantages over prior known stoves. The present stove operates at a much greater efficiency since it extracts a quantum of heat in the primary combustion chamber and a substantial amount of the remaining heat value present in the gases produced in the primary combustion chamber via their combustion in the secondary combustion chamber areas. A common control for controlling the operation of both the primary and secondary combustion areas automatically results in proper combustion in both areas. Efficient heat transfer to ambient room air is provided by directing room air through enclosures directly around the combustion chambers.

These and other objects, advantages, purposes and features of the invention will become more apparent from a study of the following description taken in conjunction with the drawings.

DESCRIPTION OF THE PREFERRED EMBODIMENT

Figure 1:
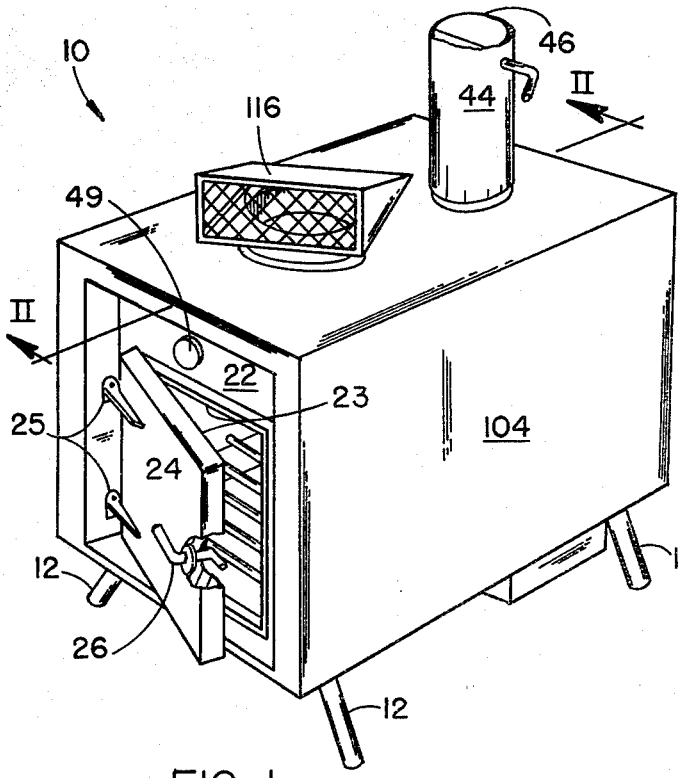
FIG. 1 is a perspective view of the heating stove or furnace of the present invention.
Figure 2:
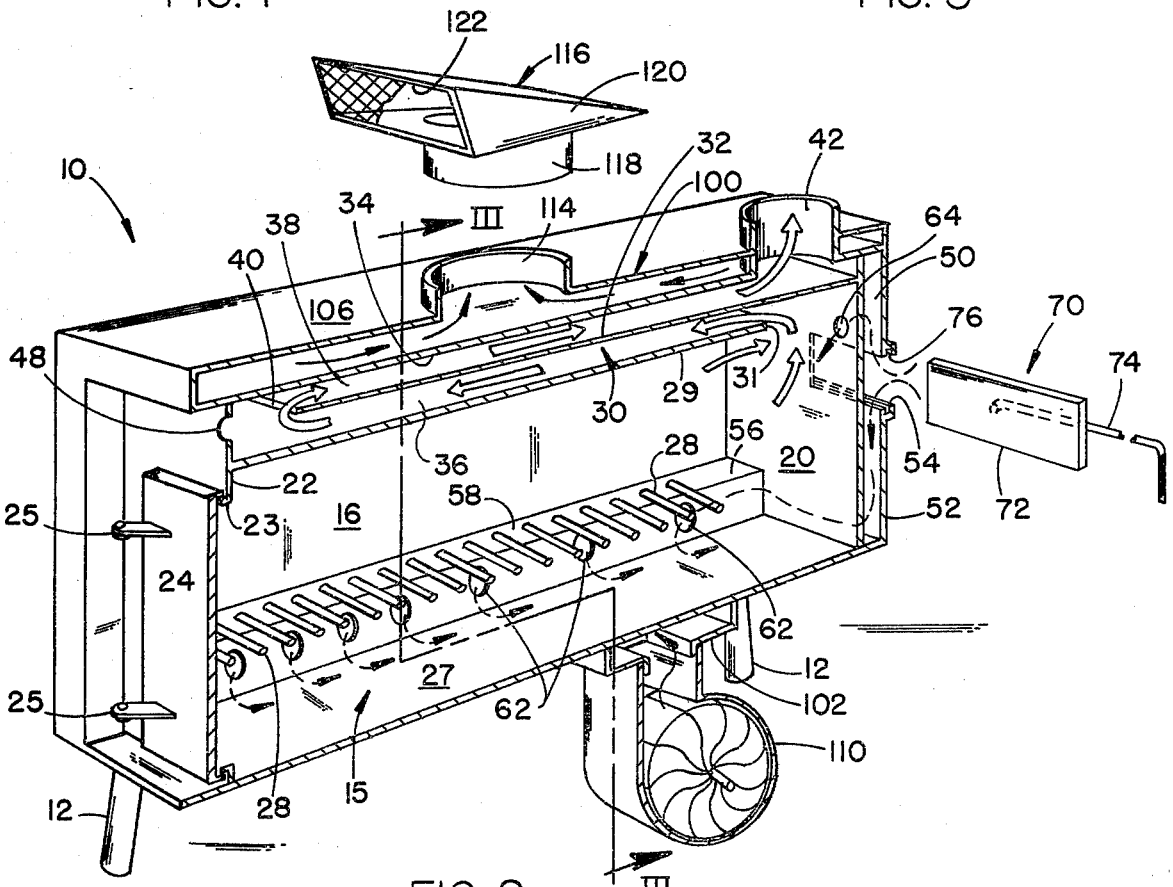
FIG. 2 is a sectional, perspective, side view of the stove or furnace taken along plane II—II of FIG. 1 showing flow through the stove with the heat diverter and draft control shown in exploded position.

Referring now to the drawings in greater detail, FIGS. 1 and 2 illustrate the heating stove or furnace 10 of the present invention which is especially designed to burn wood or other solid fuels at maximum efficiency. Generally, stove 10 is rectangularly shaped and includes support legs 12, one at each corner, for spacing the stove above a supporting surface or floor in a home or other building to provide room for an air intake thereunder. Primary combustion chamber 15 is in fluid communication with a secondary combustion area 30 positioned immediately above and over the primary combustion chamber 15. Ambient room air is drawn into the stove from beneath and heated in an air heating enclosure 100 at least partially surrounding the combustion areas of the stove. A preheating chamber 50 including manual draft control apparatus 70, or automatic, temperature-responsive draft control apparatus 80 is provided at the rear of the stove 10. A diverter 116 directs heated air as desired while moisture can be added to the heated air with humidifier 150.

Figure 3:
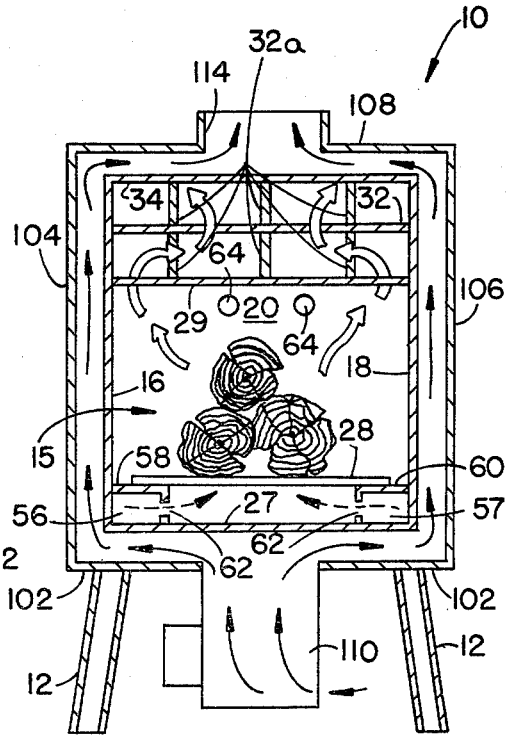
FIG. 3 is a sectional, front elevation of the heating stove or furnace showing the flow direction of heated air, combustion air, and the combustion gases taken along line III—III of FIG. 2.

As is best seen in FIGS. 2 and 3, the primary combustion chamber 15 is an elongated, rigid enclosure or housing wherein the primary burning of wooden logs or other fuel takes place. Chamber 15 is preferably formed from rigid, quarter-inch steel plate to ensure long life, proper heat conduction therethrough, and durability under high temperature conditions. Chamber 15 includes elongated, lateral side walls 16, 18, and vertically extending rear and front walls 20, 22, respectively . These walls are designed to conduct heat therethrough. Front wall 22 has a flanged, door opening 23 covered by a hinged door 24 mounted on hinges or pivots 25 as shown in FIGS. 1 and 2. Door 24 also includes a rotatable, camming latch 26 (FIG. 1) having an interior L-shaped portion which engages behind the edge of opening 23 when the door is in its closed position. The bottom of primary combustion chamber 15 is a wall 27 which extends under a grate 28 and a pair of air ducts or passageways 58, 60 leading from preheating chamber 50 to provide primary combustion air for chamber 15. The top wall of chamber 15 is provided by a steel plate 29 extending rearwardly from front wall 22 generally horizontally to an edge spaced from the rear wall 20. The shorter top wall 29 provides an opening 31 allowing entry of the gases resulting from the primary combustion in chamber 15 into secondary combustion areas 30. Opening 31 is located at the rear of the stove, opposite door 24 to provide the greatest possible length for the secondary combustion areas as explained below. Chamber 15 is designed to sustain combustion at a temperature in the range of between 1,000° and 2,000° F.

As shown in FIGS. 2 and 3, the secondary combustion areas are formed by parallel, generally horizontally extending flat steel plates 32, 34 spaced vertically one above the other and above top wall 29 of combustion chamber 15 by spacer members **32*a* (FIG. 3). Wall 32 extends from rear wall 20 of the combustion chamber forwardly to a position short of front wall 22 while wall 34 extends the complete length of the stove 10 and forms on its exterior side one surface of the air heating enclosure 100 to be described more fully below. Spaced walls 29, 32, 34 define first and second secondary combustion passageways 36, 38, respectively, one on top of the other, both of which are in position to be efficiently heated by the rising heat from primary combustion chamber 15. As above, the opening 31 at the rear of the stove allows the gases of primary combustion to pass forwardly in passageway 36 for the full length of the stove and then rearwardly in passageway 38**, again over generally the entire length of the stove. This maximizes the secondary burn area.

As shown by the outline arrows in FIGS. 2 and 3, fluid communication for flow of primary combustion gases for ignition and burning in the secondary combustion areas is provided through opening 31 along the wide, flat, horizontally extending passageway 36 to vertical opening 40 at the end edge of wall 32 adjacent the stove front. The ignited gases flow up and around the end edge of wall 32 and rearwardly in the reverse direction from that in which they were flowing in passageway 36 toward the rear of the stove to exhaust outlet 42. Outlet 42 is adjacent the rear of the stove and receives telescopingly thereover a flue or chimney pipe 44 including a butterfly-type, rotatable damper 46 and a control handle for operating the same so as to enable control of the flow of exhaust gases from secondary combustion areas 30. In situations where chimney 44 is long, damper 46 is used to restrict exhaust flow which in turn slows flow through both combustion areas and preheating area 50. A viewing port comprises a circular aperture 48 in front wall 22 is provided for determining whether proper secondary combustion of the primary combustion gases (visible as an intense, hot flame) is taking place in passageways 36, 38. Aperture 48 may be closed by a removable plate or glass fixture 49 (FIG. 1).

The forward-rearward flow orientation of secondary combustion passageways 36, 38 provides reverse direction flow to obtain sufficient length and size of the passageways to allow complete ignition and burning of the primary combustion gases before those gases exit the stove through exhaust outlet 42. Lack of sufficient length of such secondary combustion passageways could result in the escape of unburned gases through outlet 42 or the use of outlet 42 as an extension of the secondary combustion area resulting in dangerous flames therein. In the preferred embodiment of the present stove, combustion chamber 15 is 24 inches long, 18 inches wide and 13.5 inches high between grate 28 and top wall 29. This provides a total primary combustion chamber volume of 3.37 cubic feet. The secondary combustion passageways 36, 38 are approximately 24 inches long and 18 inches wide. Passageway 36 is 2 inches high while passageway 38 is 2½ inches high resulting in a total secondary combustion area of 1.00 cubic feet. A stove of such dimensions has been found to operate extremely successfully and efficiently, with substantially complete combustion of the primary fuel as well as the gases resulting from the primary combustion in the secondary combustion areas. The secondary combustion ignition temperature for gases in passageways 36, 38 is believed to be approximately 1,000° F.

Referring now to FIG. 2, fresh air for sustaining combustion in both the primary and secondary combustion areas is provided by means of an air preheating chamber 50. Chamber 50 is a fluid-tight, vertically extending, rectangular chamber formed by the exterior side of rear wall 20 of primary combustion area 15 and a parallel, vertically extending rear exterior wall 52 spaced outwardly from wall 20. Heat from wall 20 and chamber 15 heats any air present in chamber 50. A generally horizontally extending, rectangular opening 54 is provided through rear wall 52 and serves as a draft opening allowing fresh, ambient air to enter chamber 50 for preheating prior to passage into the primary or secondary combustion areas through separate opening (see the dotted arrows in FIGS. 2 and 3). Opening 54 is 3 inches by 8 inches in the preferred embodiments.

Preheated air from chamber 50 passes into air ducts 58, 60 through rectangular openings 56, 57 at the lower corners of rear wall 20. Air ducts 58, 60 extend along the bottom lower corners of primary combustion chamber 15 from back to front. These ducts are formed by solid, continuous top walls extending horizontally outwardly from the interior of walls 16, 18 and 20 of chamber 15 and by vertically extending side walls extending between the top duct walls and the bottom wall 27 of chamber 15. The laterally facing side walls of air ducts 58, 60 include a plurality of circular openings 62. The top walls of air ducts 58, 60 support a fire grate 28 (FIGS. 2 and 3) above bottom wall 27 to provide a wood ash collecting area therebeneath. Grate 28 may be raised and/or removed through door 24 to remove ashes from stove embodiment 10. Openings 62 direct air laterally under the burning wood or other fuel on grate 28 along the entire length of chamber 15 such that combustion air is provided from the sides and under the fire for efficient combustion. Air from chamber 50 is already preheated as it exits through apertures 62 into the chamber 15 to further enhance combustion and avoid the necessity of heating the air within the chamber which would otherwise slow the combustion process.

Preheating chamber 50 also provides preheated air for insertion and mixing with the gases resulting from the primary combustion as they pass through opening 31 to passageways 36, 38 for secondary combustion. Fresh, preheated air enters the secondary combustion area through a pair of circular apertures 64 (FIGS. 2 and 3) provided through rear wall 20 immediately adjacent opening 31. The dual openings provide a sufficient air intake but do not permit escape of substantial amounts of smoke or other products of primary combustion. In the preferred embodiments herein, apertures 64 are one inch in diameter. As with the primary combustion, preheated air from chamber 50 enhances complete combustion of the primary combustion gases in passageways 36, 38 because no heating of the air within those passageways is necessary to sustain the secondary combustion. Once operating temperature of the stove has been obtained, the mixing of the fresh, preheated air from aperture 64 at the beginning of the secondary passageways allows ignition of the primary combustion gases immediately after entering the passageways to enable complete combustion of such gases before they exit through exhaust opening 42.

Simultaneous control of the flow of air through opening 54, and thus primary and secondary combustion air intakes 56, 57 and 64, respectively, is obtained by one of two types of draft controls 70 or 80. Draft control 70 is a manually operable cover plate 72 of planar configuration having a size sufficiently large to cover the entirety of opening 54 when in closed position. A T-shaped operating handle 74 is welded or otherwise secured to the exterior of plate 72 to allow movement of the plate even when the stove is at operating temperatures. Plate 72 is slidably mounted across the opening 54 by means of L-shaped, channel-like guide flanges 76 adjacent the top and bottom edges of opening 54 (FIG. 2). Such guide flanges allow the plate 72 to be slid across opening 54 to open or close the same. As will be appreciated, opening of the single plate 72 allows air to enter chamber 50 and also simultaneously controls the amount of flow through intake apertures 56, 57 and 64.

The single, common control for both intakes eliminates the need to separately proportion or control those intakes each time the stove combustion is adjusted. If too much combustion air were allowed to the primary chamber and too little to the secondary area, the amount of primary combustion gases entering the secondary areas would increase, and insufficient oxygen or air would be present in the secondary areas to allow the gases to burn to completion. This would lower the efficiency of the stove. Conversely, if too little air were allowed to the primary chamber and too much air allowed to the secondary areas, the primary fire would burn more slowly thus lowering the temperature of the stove. In addition, too much air would enter the secondary areas thereby lowering the temperature therein and possibly eliminating the secondary combustion in those areas. Hence, proper and simultaneous control by means of the single draft control 70 enables efficient operation of the stove at all times without individual control of the primary and secondary intakes 56, 57 and 64.

Referring again to FIGS. 1–3, efficient heating of ambient room air by the maximum efficiency primary and secondary combustion chambers described above is obtained by air heating enclosures 100 extending at least partially around the rigid combustion chambers. Enclosures 100 are provided by a horizontally extending bottom wall 102, vertically extending side walls 104, 106, and a horizontally extending top wall 108 all of which are spaced outwardly from the corresponding walls of the combustion chambers to which they are immediately adjacent. Such spacing provides fluid-tight, air heating chambers through which ambient room air is forced by a fan 110 which blows or forces cool, room air, taken from adjacent the floor level around the stove, into the air heating chambers between walls 102, 104, 106 and 108 and the walls of the combustion chambers. Fan 110 is a rotary or centrifugal-type fan having a rotor wheel therewithin operated by an electric motor. The fan is controlled by an on-off switch at junction box 111 (FIG. 10) unless an automatic control responsive to stove temperature is provided as set forth below. The fan draws air laterally inwardly and forces it upwardly into the air heating enclosures. As shown by the solid arrows in FIGS. 2, 3, 5 and 6, forced air is efficiently heated by intimate contact with the heated surfaces of the combustion areas in the air heating enclosures and passes upwardly to heated air outlet 114 at the top of the stove. Preferably, fan 110 is a "Shaded Pole Blower" fan having a capacity of 465 cubic feet of air per minute, Model No. 4C264, manufactured by Dayton Electric Manufacturing Company, Chicago, Illinois.

A heat diverter 116 is telescopically fitted over the collar of heated air outlet 114. Diverter 116 includes a pipe section 118 communicating with a wedge-shaped hood 120 having an opening 122 extending in only one direction. Opening 122 may be covered with a screen to prevent the escape of any undesired objects from the air heating enclosures. Diverter 116 may be pivoted around opening 114 to direct air forced by fan 110 into any desired area of the room in which the stove or furnace is situated. Outlet 114 may also be connected to the force air system of a home or other building as a supplemental or sole source of heated air through ducts in the building.

Figure 4:
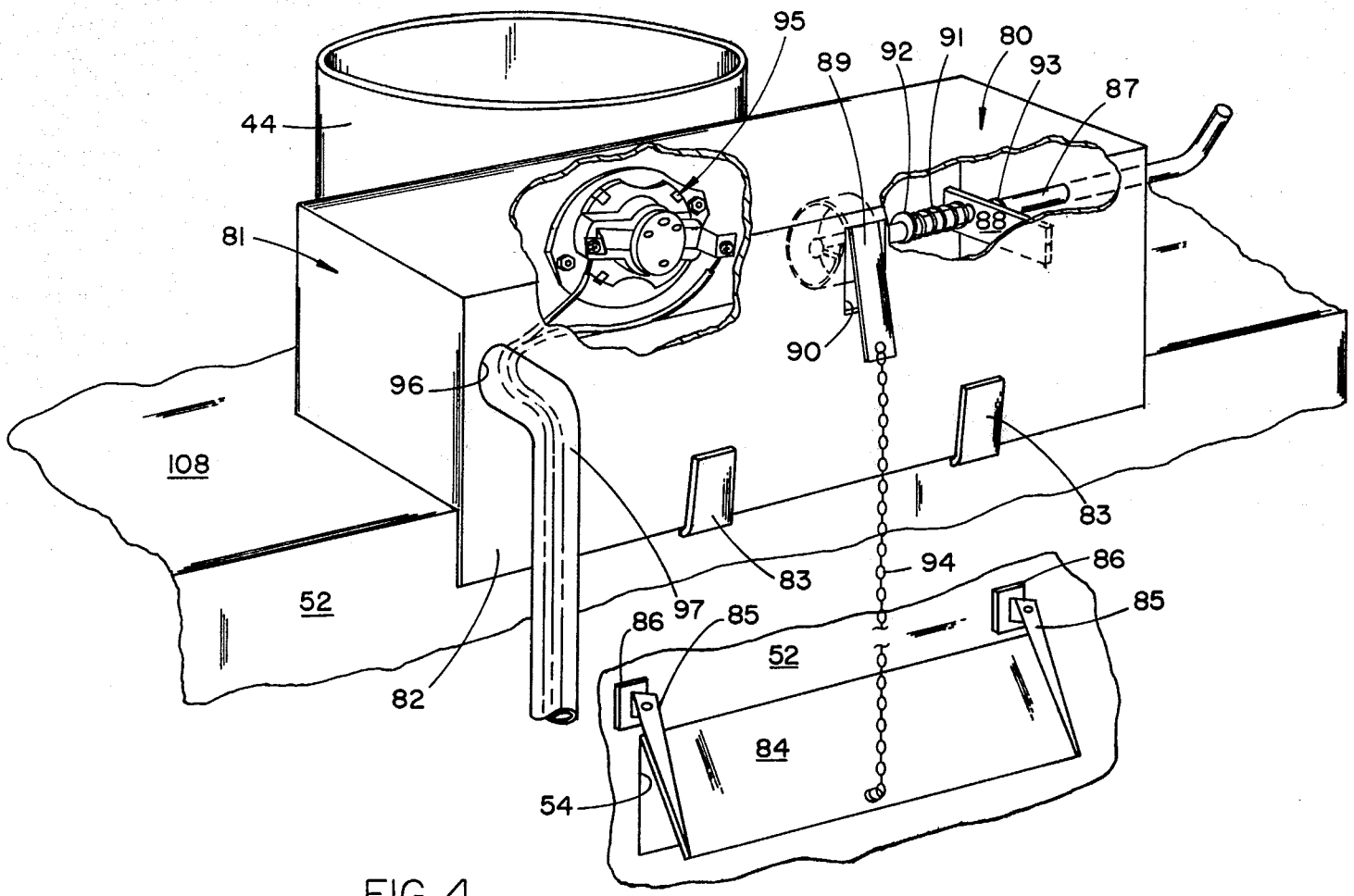
FIG. 4 is an exploded, perspective view of an automatic draft control and fan control for the heating stove or furnace of the present invention shown secured at the rear of the stove or furnace.
Figure 10:
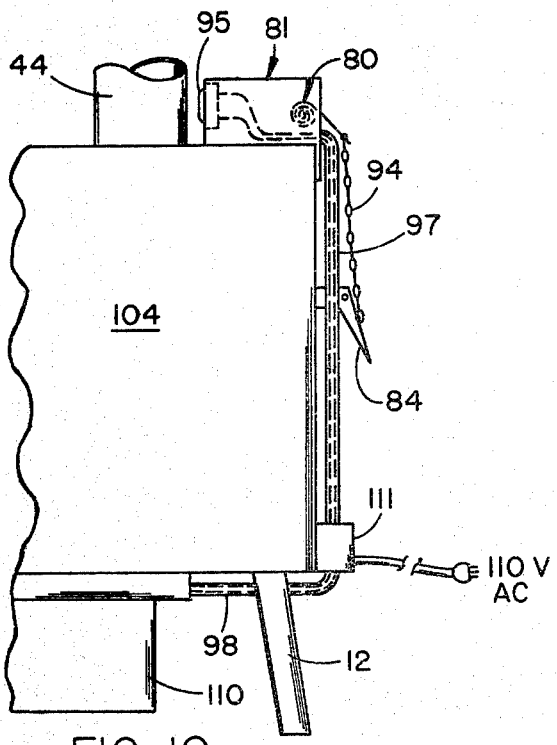
FIG. 10 is a fragmentary side elevation of the rear portion of the stove of the present invention showing the automatic draft control and fan control of FIG. 4 as installed.

Referring now to FIGS. 4 and 10, an alternate, automatic draft control 80 and an automatic, temperature-responsive, fan control switch 95 are shown positioned on the top of the rear portion of the stove. Controls 80 and 95 are used together in place of a manual on-off switch for fan 110, normally mounted on junction box 111, and the manual sliding draft control 70 to provide automatic operation of the stove if desired. These controls are mounted in a rectangular, sheet metal housing 81 which opens downwardly and rests on the top, rear of the stove. Housing 81 includes a lower flange 82 which slides between the rear wall 52 and a pair of upwardly, outwardly extending flanges or mounting clips 83 to hold the housing in place on the stove.

Automatic draft control 80 includes a rectangular draft opening covering plate 84 of sufficient size to cover opening 54 in rear wall 52. Plate 84 is hingedly secured via L-shaped flanges 85 to projections 86 on rear wall 52. Spaced above door 84 and mounted within housing 81 is a horizontal control rod 87 rotatably mounted through an aperture in a support 88 on the interior of the housing and through an aperture in one end wall of housing 81. A temperature-responsive, bimetallic control element 89 is secured to the inner end of rod 87 in a coiled fashion such that its free end extends outwardly through a rectangular opening 90 in the rear wall of housing 81 directly over the center of door 84. The opposite end of rod 87 is bent to form a handle to allow setting of the automatic control. A spacing spring 91 extends between support 88 and a washer 92 secured intermediate bimetallic element 89 and the support to urge rod 87 inwardly of the housing, while a washer 93 secured on the opposite side of support 88 limits the inward movement of the rod. A flexible chain 94 extends from the free end edge of bimetallic element 89 to the lower edge of hinged door 84. As stove 10 reaches its operating temperature, bimetallic temperature-responsive element 89 increases in length lowering chain 94 and door 82 to close opening 54. Such closing simultaneously reduces the amount of air entering the primary and secondary combustion areas, lowers the temperature of the stove and maintains it at a manageable combustion level. Conversely, if the operating temperature of the stove cools too much, bimetallic element 89 contracts, raising chain 94 and door 84, allowing a greater amount of air to enter the primary and secondary combustion areas. The operating temperature of the stove is thereby increased. The handle at the exterior end of rod 87 is used to rotate element 89 and thus initially set the opening of door 84 so that the operating temperature of the stove or furnace is maintained as desired.

Suitable bimetallic elements useful in the invention may be obtained from Crest Manufacturing Company, 5 Hood Drive, Lincoln, Rhode Island, Part No. 81064, entitled "Thermostatic Bimetal" or W. M. Chace Company, 1600 Beard Avenue, Detroit, Michigan, Product No. 6650, entitled "Thermostatic Metal".

Automatic fan control switch 95 is a temperature-responsive electrical switch mounted through an opening in the front wall of housing 81 as shown in FIGS. 4 and 10. The temperature sensor of unit 95 is positioned exterior of the housing immediately adjacent exhaust stack 44 (FIG. 10) so as to be immediately responsive to the temperature of the stove especially at the exhaust stack. Unit 95 is connected by suitable electric wires which pass through an aperture 96 in the rear wall of housing 81 and downwardly through a flexible or other metal electrical wire conduit 97 to junction box 111 at the lower, rear portion of the stove. A conduit 98 including the electrical wires from the motor of fan 110 leads under the stove to the junction box 111 for connection with the wires leading from unit 95. Power is supplied by a suitable line cord to the junction box from a 110 volt AC outlet in the conventional manner. A suitable temperature-sensing switch unit 95 useful in the invention is manufactured by the Dayton Electric Manufacturing Company of Chicago, Ill., as Product No. 2E246 entitled "Snap-Disc Fan Thermostat". Such sensing unit is preset to start the fan whenever the stove temperature reaches 120° F. and to stop the fan whenever the stove temperature is below 100° F. Accordingly, when both the automatic draft control 80 and fan control 95 are used in housing 81, operation of the stove after initial setting occurs without manual adjustment.

Figure 6:
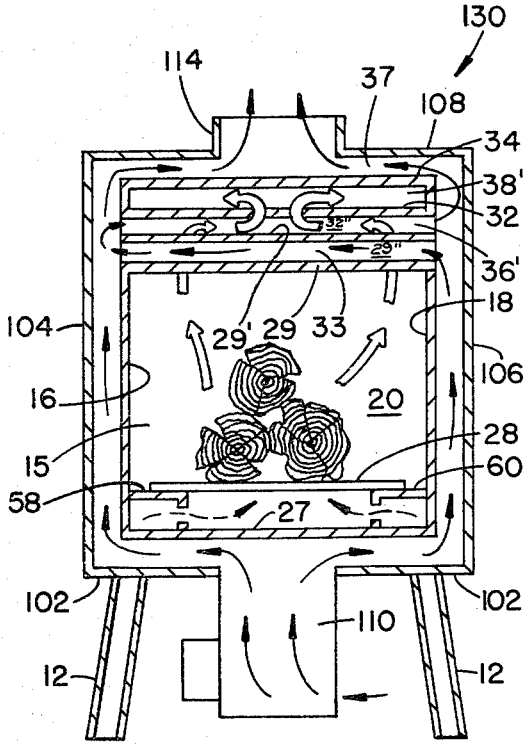
FIG. 6 is a sectional, front elevation of the modified heating stove or furnace taken along line VI—Vi of FIG. 5.
Figure 5:
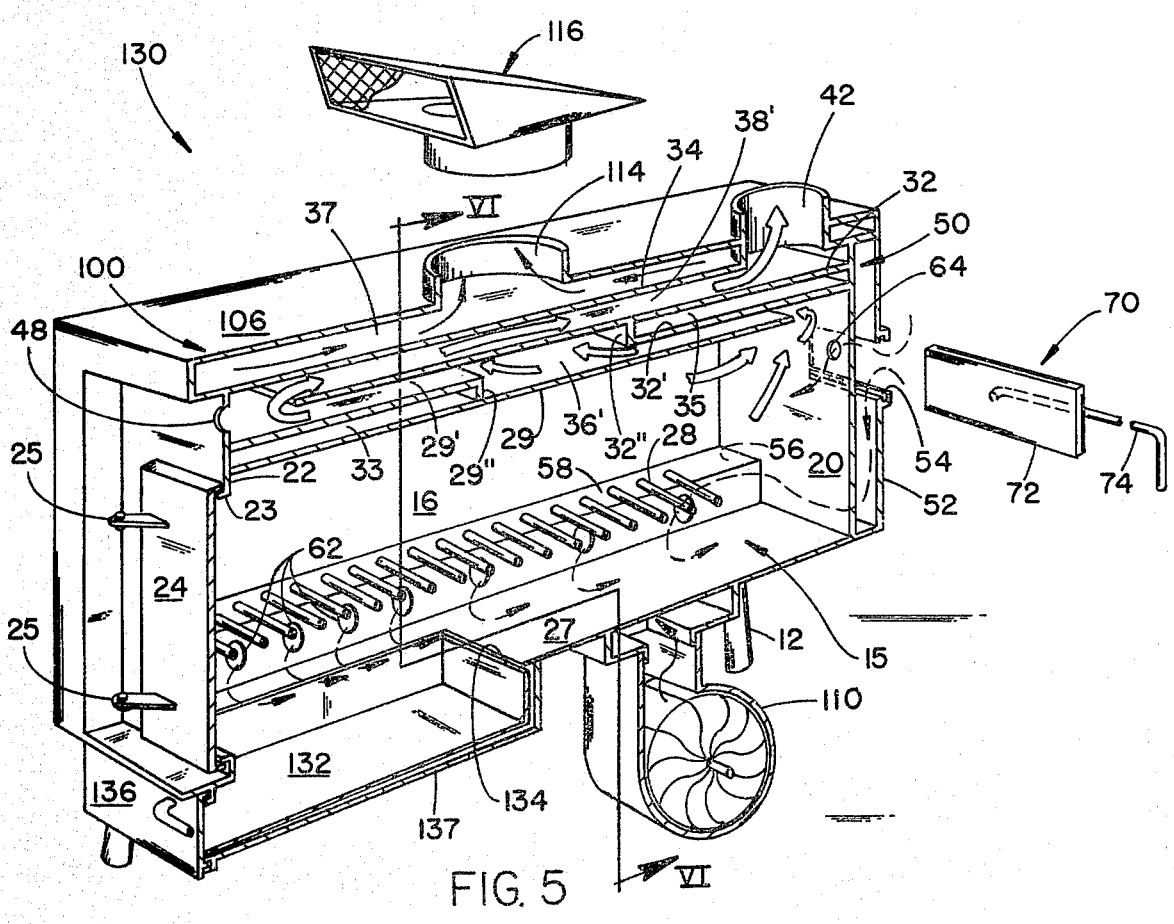
FIG. 5 is a sectional, perspective, side view similar to FIG. 2 but illustrating a modified embodiment of the heating stove or furnace.

Referring to FIGS. 5 and 6, an alternative embodiment 130 of the heating stove or furnace is shown. Stove 130 is substantially the same as embodiment 10 thereof and like numerals indicate like parts on the two embodiments. However, stove 130 includes a modified, secondary combustion area as well as a drawer-type ash pan enabling removal of wood ashes more easily and even during operation of the stove.

As is best seen in FIG. 5, ash pan drawer 132 is a rectangular, metal drawer fitted below a rectangular aperture 134 in the front of bottom wall 27 of primary combustion chamber 15. Drawer 132 includes a face 136 having flanges mating with corresponding flanges on the front wall 22 of the stove below door 24. The entire drawer 132 slides in and out on a metallic tray or pan recess 137 extending downwardly from the bottom wall of the combustion chamber below aperture 134. Ashes may be swept from the rear portion of the combustion chamber into the drawer and the drawer slid outwardly to remove the same without removing grate 28 from its position.

In addition, stove 130 includes additional air heating passageways 33, 35 extending through and between the secondary combustion passageways. Passageways 33, 35 communicate with those on the sides of the stove to more efficiently heat the air before it is forced out of opening or outlet 114.

As is seen in FIGS. 5 and 6, spaced above the top wall 29 of the primary combustion chamber is a second parallel wall 29'. Walls 29 and 29' are fastened to the front wall 22 and are closed by a short vertical wall 29" forming fluid-tight chamber 33 extending across the stove and communicating with the heated air enclosures on either side of the stove between walls 104 and 16 and 18 and 106 as shown in FIG. 6.

Another heated air passageway 35 extends horizontally between rear wall 20 and a position spaced forwardly of that wall but rearwardly of passageway 33. Wall 32 extends along and parallel to wall 29 as in stove embodiment 10 and ends short of front wall 22 over passageway 33. A second, parallel wall 32' secured to rear wall 20 is spaced below wall 32. Together with a short vertical wall 32", wall 32' forms the fluid-tight passageway 35. Walls 32 and 34 define a secondary combustion area 38' as in the previous embodiment. Secondary combustion area 36' is formed between walls 29, 29', 32 and 32' and vertical walls 29" and 32". With horizontal heated air passageway 37 between walls 34 and 108, a total of three, heated air, horizontal passageways are provided in embodiment 130. As is shown by the outline arrows in FIGS. 5 and 6, the combustion passage from the primary combustion chamber continues on a path through secondary combustion passageways 36', 38', below passageway 35 and above passageway 33, and out through exhaust outlet 42 after secondary combustion. As shown by the solid arrows, heated air passes upwardly through the vertically extending heated air enclosures and laterally across and between the secondary combustion areas in passageways 33, 35 and 37 for further heating efficiency in this embodiment.

Figure 7:
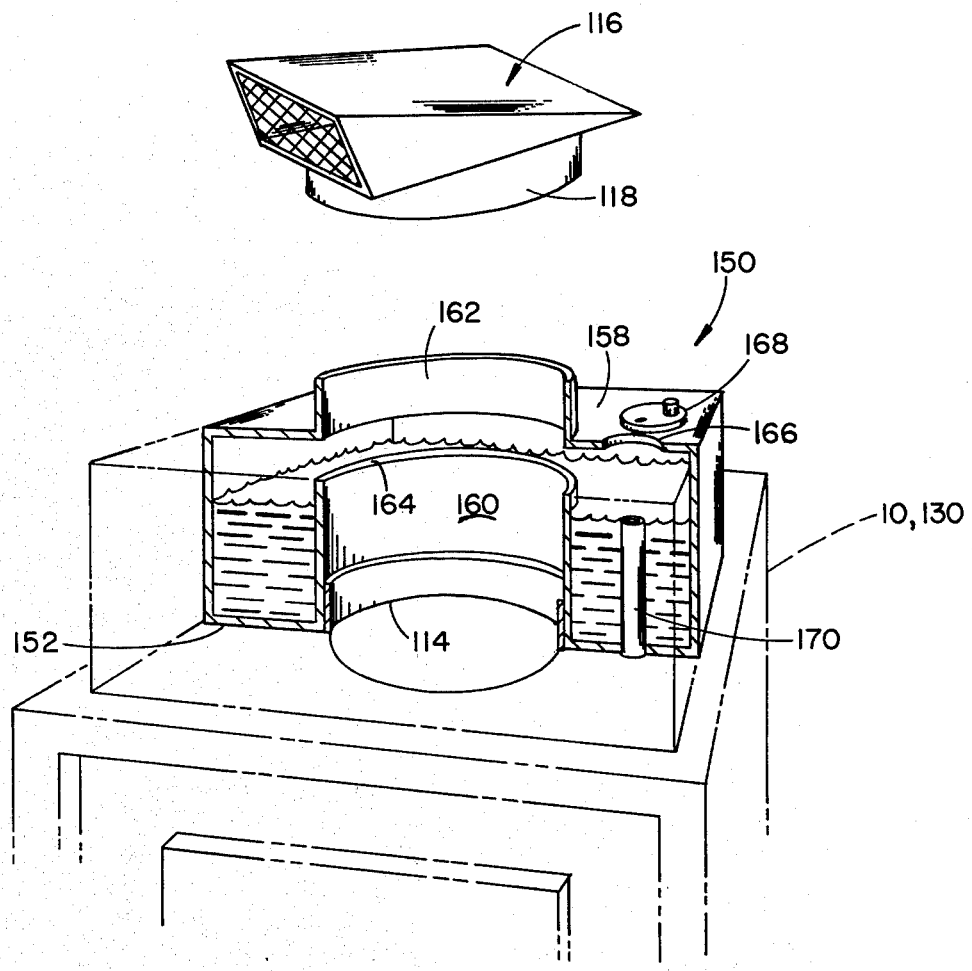
FIG. 7 is a sectional, front perspective view of a humidifier forming a part of the present invention with a heat diverter therefor shown in exploded relation.
Figure 8:
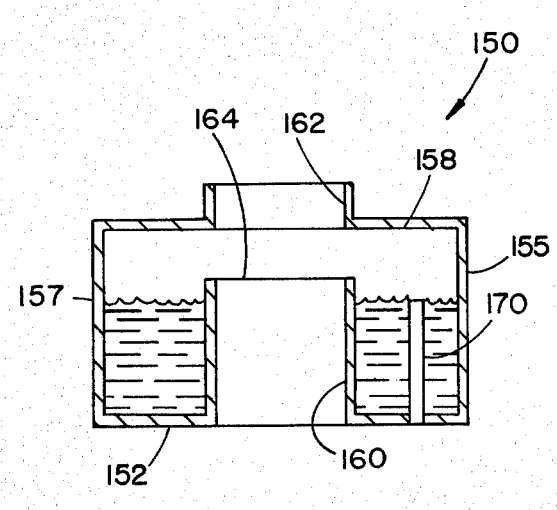
FIG. 8 is a sectional, front elevation of the humdifier shown in FIG. 7.
Figure 9:
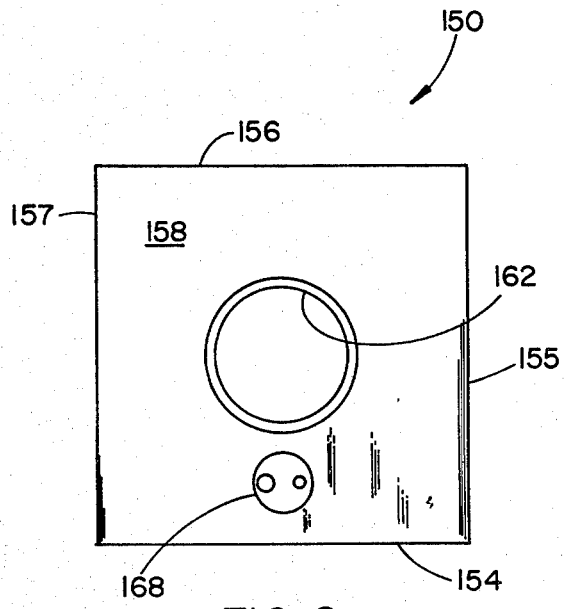
FIG. 9 is a top, plan view of the humidifer shown in FIGS. 7 and 8.

As shown in FIGS. 7–9, moisture is added to the air heated with stoves 10 or 130 with humidifier 150. The humidifer is a fluid-tight tank formed by bottom wall 152, side walls 154, 155, 156 and 157, and a top wall 158. A right circular, cylindrical tube 160 is secured centrally within bottom wall 152 extending upwardly into the tank but short of the top wall 158. Tube 160 forms a cylindrical air passageway upwardly through the humidifier tank. A tubular collar 162 is secured around an aperture in top wall 158 coaxial and parallel with tube 160 to complete the air passageway through the tank. The top edge 164 of tube 160 and the bottom interior portion of top wall 158 define a circumferential, laterally extending opening to the interior water-holding portion of the humidifying tank. A filling aperture 166 is provided in the top wall 158 and includes a circular, pivotally mounted cover 168 for movement thereover. Also included is a depth gauge 170 comprising a solid rod fitted and sealed in bottom wall 152 and extending upwardly a distance short of top edge 164 of tube 160 to indicate the uppermost level to which the tank should be filled.

In operation, tube 160 is slightly larger than the tubular collar 114 around the heated air outlet of stoves 130 or 10. The humidifying tank 150 is seated around outlet 114, filled with water through aperture 166 and allowed to become heated from the heat of the stove. The heat vaporizes the water which vapor passes through the lateral, circumferential opening between edge 164 and the bottom of top wall 158 to mix with the heated air passing upwardly through the central aperture through the tank and out of heated air outlet 114. In addition, collar 162 receives the telescoping pipe 118 of heat diverter 116 which is fitted over the humidifier to direct heated air containing moisture from the humidifer to various portions of the room in which the furnace is situated. In the preferred embodiment, tank 150 has an 18-quart capacity enabling the insertion of water vapor into the air for approximately 9–24 hours when operated with stove 10 or 130 at an approximate temperature of 200°–300° F. on top of the stoves.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows:

1. A heating stove or furnace comprising:

a combustion enclosure having a primary combustion chamber for burning fuel and a secondary combustion area in fluid communication with said primary combustion chamber for receiving and further combusting the gases of combustion from said primary combustion chamber;

an air heating enclosure at least partially surrounding said combustion enclosure for passing ambient air for heating;

combustion air intake means for controlled admission of fresh, ambient air to said primary combustion chamber and said secondary combustion area, said combustion air intake means including means for preheating said fresh, ambient air prior to admission to said combustion chamber and area;

an exhaust outlet at the rear of said stove or furnace for exhausting the products of combustion after passage through said secondary combustion area;

ambient air intake means for admitting ambient air to said air heating enclosure;

a heated air outlet for exhausting heated air from said air heating enclosure;

means for inserting fuel in said primary combustion chamber;

said secondary combustion area including first and second generally horizontally extending, secondary combustion passageways located vertically above said primary combustion chamber, said first secondary combustion passageway communicating with said primary combustion chamber at the top and rear of said primary chamber opposite said fuel inserting means and extending forwardly to the front of said stove or furnace into communication with said second combustion passageway which extends vertically over said first secondary passageway and rearwardly into communication with said exhaust outlet, said secondary passageways being separated from said primary chamber and one another by heat-conducting walls and having a combined length and size sufficient to allow ignition and burning of the gases of combustion from said primary combustion chamber prior to exhaustion through said exhaust outlet;

said combustion air intake means for said secondary combustion area including an intake opening adjacent the junction between said primary combustion chamber and said first secondary combustion passageway to facilitate secondary combustion of said gases in said secondary passageways.

2. The heating stove or furnace of claim 1 wherein said primary combustion chamber is elongated; said means for inserting fuel including a loading aperture at the front of said primary combustion chamber and a door fitted thereover; said secondary combustion passageways being elongated, vertically thinner than said primary chamber, and extending over the entire width of said primary chamber.

3. The heating stove or furnace of claim 1 including two pair of spaced walls, a first pair extending between said first and second passageways, the second pair extending between said primary combustion chamber and said first passageway, said pairs of walls forming air heating chambers extending across the width of said stove and communicating with said air heating enclosure but physically separated from said first and second fluid passageways.

4. The heating stove or furnace of claim 3 wherein said air heating enclosure includes air passages extending under, upwardly along the sides of, and over top said combustion enclosure from said ambient air intake beneath said stove to said heated air outlet at the top of said stove.

5. The heating stove or furnace of claim 1 wherein said means for preheating said fresh, ambient air include a fluid-tight, common, air preheat chamber for both said primary chamber and secondary area extending along one portion of said primary combustion chamber; said preheat chamber having an ambient air intake opening and draft control means for closing said ambient air intake opening as desired to control ambient air flow through said opening, said preheat chamber, and to both said primary combustion chamber and secondary combustion areas.

6. The heating stove or furnace of claim 5 wherein said air preheat chamber includes at least one primary combustion air intake opening extending between said preheat chamber and primary combustion air passageway means for directing preheated, fresh air to said primary combustion chamber.

7. The heating stove or furnace of claim 6 including a pair of primary combustion air intake openings between said preheat chamber and said primary combustion air passageway means; said primary combustion air passageway means including air ducts extending from said primary combustion air intake openings located at the rear of said primary combustion chamber along the bottom of both lateral sides of said primary combustion chamber; said ducts being closed along their tops and supporting a grate for supporting wood or other fuel to be burned.

8. The heating stove or furnace of claim 5 wherein said draft control means include a cover plate for extending over said ambient air intake opening and means for slidably mounting said cover plate for horizontal movement across and over said intake opening whereby the size of said intake opening is manually adjustable.

9. The heating stove of claim 5 wherein said draft control means include a cover plate for covering said ambient air intake opening, means for pivotally mounting said cover plate over said opening, a bi-metallic, temperature-responsive element positioned vertically above said pivotally mounted cover plate, flexible means for connecting said bi-metallic element to said cover plate, and means for supporting and positioning said bi-metallic element on said stove, said bi-metallic element expanding or contracting in relation to the temperature adjacent said stove whereby said flexible means are raised or lowered thus automatically opening or closing said cover plate in relation to the temperature of said stove.

10. The heating stove or furnace of claim 1 wherein said combustion air intake means include air ducts for passing preheated air from said means for preheating said fresh, ambient air into said primary combustion area, said air ducts extending along the bottom and on either lateral side of said primary combustion chamber and including closed top walls and a plurality of laterally directed side openings; a grate for supporting wood or other fuel to be burned extending over and between said ducts whereby combustion air is directed to said fuel from under and alongside the area of combustion.

11. The heating stove and furnace of claim 1 wherein said air heating enclosure includes fluid-tight air heating passages extending vertically upwardly immediately adjacent the lateral sides of said primary combustion area and communicating with at least one generally horizontally extending air heating passageway extending across said secondary combustion area which extends horizontally over top said primary combustion chamber; said ambient air intake means communicating with said vertically extending air heating passageways.

12. The heating stove or furnace of claim 11 wherein said ambient air intake means include a fan for forcing air through said air heating passageways beside and over said primary and secondary combustion chamber and area and out said heated air outlet.

13. The heating stove or furnace of claim 12 including means for automatically controlling operation of said fan in response to the temperature of said stove.

14. The heating stove or furnace of claim 1 including air diverter means fitted on said heated air outlet for diverting heated air laterally of said stove.

15. The heating stove or furnace of claim 1 including humidifying means fitted on said heated air outlet for adding moisture to said heated air, said humidifying means including a fluid-tight water tank extending around said outlet and having an opening directed laterally inwardly of said outlet and into a vertically upwardly extending opening communicating with said lateral opening, and means for inserting water in said tank.

16. The heating stove or furnace of claim 1 including a viewing opening extending into said secondary combustion area from the exterior of said stove for determining the presence and efficiency of the secondary combustion of said gases from said primary combustion in said secondary combustion area.

17. A heating stove or furnace for burning fuel and the gases of combustion produced by the burning fuel comprising:

a combustion enclosure having a primary combustion chamber and a secondary combustion area extending over the top of and in fluid communication with said primary combustion chamber, said secondary combustion area having a length and size sufficient to allow ignition and burning of the gases of combustion from said primary combustion chamber therewithin prior to exhaustion from said secondary exhaust outlet;

an air heating enclosure at least partially surrounding said combustion enclosure for passing ambient air for heating;

ambient air intake and exhaust means for admitting ambient room air to and exhausting heated air from said air heating enclosure;

at least one primary combustion air intake opening for admitting fresh air to said primary combustion chamber;

at least one secondary combustion air intake opening for admitting fresh air to said secondary combustion area;

common preheat means for simultaneously preheating ambient air and directing said preheated air to both said primary and secondary combustion air intakes, said preheat means including a fluid-tight air preheat chamber extending along one portion of said primary combustion chamber, a common, ambient air intake in said preheat chamber and draft control means having a draft control member movably secured over said ambient air intake for simultaneously controlling ambient air flow through said ambient air intake, said preheat means, and both said primary and secondary combustion air intakes; and means for inserting fuel into said primary combustion chamber.

18. The heating stove or furnace of claim 17 wherein said primary combustion chamber is elongated; said means for inserting fuel including a loading aperture at the front of said primary combustion chamber and a door fitted thereover; said secondary combustion area including at least one elongated, secondary passageway opening to said primary combustion area at the rear of said primary chamber opposite said door, said secondary passageway extending generally horizontally over said primary chamber and physically separated therefrom by at least one heat-conducting wall.

19. The heating stove or furnace of claim 17 wherein said secondary combustion area includes two elongated, secondary combustion passageways extending generally horizontally over said primary combustion chamber and physically separated therefrom and from each other by heat-conducting walls; one secondary combustion passageway communicating with one end of said primary combustion chamber at the top thereof and extending toward the other end of said primary combustion chamber above the top wall of said chamber, said other secondary combustion passageway extending in the reverse direction from said one secondary combustion passageway and extending above the uppermost wall of said one secondary passageway and communicating with said one secondary combustion passageway at said other end and with said exhaust outlet at the end of said other passageway opposite said other end.

20. The heating stove or furnace of claim 19 including a plurality of air heating passageways communicating with said air heating enclosure and extending intermediate said secondary combustion passageways, at least one of said air heating passageways extending between said top wall of said combustion chamber and said one secondary combustion passageway, at least another of said air heating passageways extending between said one and said other secondary combustion passageways.

21. The heating stove or furnace of claim 17 including a pair of primary combustion air intake openings and air ducts extending from said primary combustion air intake openings located at the rear of said primary combustion chamber along the bottom of both lateral sides of said primary combustion chamber; said ducts being closed along their tops and supporting a grate for supporting wood or other fuel to be burned.

22. The heating stove and furnace of claim 17 wherein said air heating enclosure includes fluid-tight air heating passages extending upwardly immediately adjacent the lateral sides of said primary combustion area and communicating with at least one generally horizontally extending air heating passageway extending across said secondary combustion area; said secondary combustion area extending horizontally over top said primary combustion chamber; said ambient air intake and exhaust means including an ambient air intake communicating with said vertically extending air heating passageways and a heated air outlet at the top of said stove.

23. The heating stove or furnace of claim 22 wherein said ambient air intake and exhaust means include a fan for forcing air throough said air heating passageways beside and across said combustion chamber and area and out said heated air outlet.

24. A heating stove or furnace especially adapted for burning solid fuels such as wood comprising:

a combustion enclosure for burning solid fuel therein;

combustion air intake means at the rear of said stove or furnace for controlled admission of fresh, ambient air to said combustion enclosure including means for preheating said fresh, ambient air prior to admission to said combustion enclosure;

a pair of air ducts, each duct extending from said combustion air intake means into said combustion enclosure along one of the bottom sides of said enclosure to the front of said stove or furnace, said ducts being closed along their tops, supporting a grate for supporting wood or other fuel to be burned thereover, and having a plurality of laterally directed openings for admitting air from under and along the sides of said grate and under and along the sides of fuel when burned in said combustion enclosure toward the center of said stove or furnace such that said air flows upwardly through and around the fuel; and an exhaust outlet for exhausting products of combustion from said combustion enclosure.

* * * * *

UNITED STATES PATENT AND TRADEMARK OFFICE

CERTIFICATE OF CORRECTION

PATENT NO. : 4,206,743

DATED : June 10, 1980

INVENTOR(S) : W. Wally Niemela

It is certified that error appears in the above-identified patent and that said Letters Patent are hereby corrected as shown below:

Column 8, line 40:

"97" should be --95--

Column 14, claim 23, line 36:

"throough" should be --through--

Signed and Sealed this

*Third* Day of *March 1981*

[SEAL]

*Attest:*

RENE D. TEGTMEYER

*Attesting Officer*

*Acting Commissioner of Patents and Trademarks*